US009527562B1

(12) United States Patent
Sterling

(10) Patent No.: US 9,527,562 B1
(45) Date of Patent: Dec. 27, 2016

(54) PADDLE BOARD DOCK RACK

(71) Applicant: Shawn M. Sterling, Kearney, NE (US)

(72) Inventor: Shawn M. Sterling, Kearney, NE (US)

( * ) Notice: Subject to any disclaimer, the term of this patent is extended or adjusted under 35 U.S.C. 154(b) by 0 days.

(21) Appl. No.: 14/976,378

(22) Filed: Dec. 21, 2015

(51) Int. Cl.

| | |
|---|---|
| ***B63C 3/04*** | (2006.01) |
| ***B63C 15/00*** | (2006.01) |
| ***B63B 21/00*** | (2006.01) |
| *B63C 3/06* | (2006.01) |

(52) U.S. Cl.
CPC ..... *B63C 15/00* (2013.01); *B63B 21/00* (2013.01); *B63C 3/04* (2013.01); *B63C 3/06* (2013.01)

(58) Field of Classification Search
CPC ..... B63C 3/00; B63C 3/02; B63C 3/04; B63C 3/06; B63C 3/12; B63C 3/14; B63C 15/00
See application file for complete search history.

(56) References Cited

U.S. PATENT DOCUMENTS

| | | | | | |
|---|---|---|---|---|---|
| 2,185,083 | A * | 12/1939 | Horton | B63C 3/06 | 114/365 |
| 2,829,781 | A * | 4/1958 | Nomsen | B63C 3/06 | 114/51 |
| 3,087,628 | A * | 4/1963 | Jester | B63C 3/06 | 414/678 |
| 3,401,806 | A * | 9/1968 | Schmit | B63C 3/06 | 114/366 |
| 4,157,596 | A * | 6/1979 | Green | B63B 17/00 | 114/365 |
| 4,763,593 | A * | 8/1988 | Lasko | B63C 3/04 | 114/373 |
| 4,764,081 | A * | 8/1988 | Peterson | B63C 3/06 | 114/44 |
| 5,222,830 | A * | 6/1993 | Raguse | B63C 3/12 | 114/44 |
| 8,137,028 | B2 * | 3/2012 | Wrobbel | B63C 3/00 | 114/366 |
| 9,278,735 | B1 * | 3/2016 | Gaiser | B63C 3/06 | |
| 2012/0251242 | A1 * | 10/2012 | Kollar | B63C 3/00 | 405/1 |
| 2016/0083059 | A1 * | 3/2016 | Kroeger | B63C 3/12 | 405/3 |

FOREIGN PATENT DOCUMENTS

| | | | |
|---|---|---|---|
| FR | 1173236 A | * | 8/1957 |
| FR | 2492333 | * | 4/1982 |

* cited by examiner

*Primary Examiner* — Sunil Singh
(74) *Attorney, Agent, or Firm* — Dennis L. Thomte; Thomte Patent Law Office LLC

(57) ABSTRACT

A paddle board rack is provided and which is designed to be secured to one side of a dock which extends outwardly into a body of water. The paddle board rack of this invention includes a vertically disposed mounting frame which is secured to one side of the dock. A lift frame is selectively vertically adjustably secured to the mounting frame. The lift frame includes a pair of lift arms which extend outwardly from the lower end of the lift frame. The lift arms are selectively movable from a first horizontally extending paddle board loading/unloading position to a substantially vertically disposed paddle board storage or rack position whereby the paddle board is positioned between the lift arms and the lift frame.

6 Claims, 14 Drawing Sheets

PADDLE BOARD DOCK RACK

BACKGROUND OF THE INVENTION

Field of the Invention

This invention relates to a paddle board dock rack which is designed to be secured to one side of a boat dock. More particularly, this invention relates to a paddle board dock rack which enables a paddle board to be easily lifted from the water and stored at one side of the dock.

Description of the Related Art

Paddle boards or paddleboards have become very popular in the last several years. The paddle boards are usually launched from the shore of a body of water or launched from one side of a boat dock. When the paddle board is launched from the shore and returned to the shore, the person must drag the paddle board from the body of water and carry it or pull it to some other location for storage. When the paddle board is launched from one side of a boat dock, the person must usually get into the water to use the paddle board. When the person returns to the boat dock, the person must usually get into the water to lift the paddle board onto the dock.

In an effort to more easily launch the paddle board and to later dock the same, paddle board lifts or racks have been provided to enable the user to have a way to store the paddle board between times of usage.

One of the prior art paddle board storage devices is a lift or rack provided at one side of the boat dock which enables the paddle board to be lifted somewhat out of the water to be stored at one side of the boat dock. However, the prior art paddle board lifts or racks require the user to enter the water and position the paddle board onto the lift. Further, the prior art paddle board lifts or racks are not convenient to use. Additionally, the prior art paddle board lifts or racks are not able to accommodate paddle board of various sizes.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The paddle board dock rack of this invention is designed to be secured to one side of a conventional boat dock having a platform or a deck. The paddle board dock rack includes a vertically disposed mounting frame which is configured to be secured to one side of the dock. The mounting frame has an upper end, a lower end, a first side and a second side. In the preferred embodiment, first and second vertically disposed and horizontally spaced-apart tubes are secured to the mounting frame. A vertically disposed lift frame having an upper end, a lower end, and a first side and a second side, is selectively vertically adjustably secured to first and second tubes of the mounting frame. The lift frame is selectively vertically movable between an upper position and a lower position with respect to the first and second tubes and the mounting frame. The lift frame has a pair of slide blocks secured thereto which are slidably mounted on the first and second tubes respectively and which may be locked in position with respect to the first and second tubes between their upper and lower ends.

A lift handle is secured to the upper end of the lift frame which extends upwardly therefrom so that a person on the dock may grasp the lift handle and move the lift frame between its upper and lower positions. A first support leg, having inner and outer ends, extends downwardly and then outwardly from the lower end of the lift frame at the first side thereof. A second support leg, having inner and outer ends, extends downwardly and then outwardly from the lower end of the lift frame at the second side thereof.

A third support leg, having inner and outer ends, has its inner end selectively pivotally secured, about a horizontal axis, to the outer end of the first support leg. A fourth support leg, having inner and outer ends, has its inner end selectively pivotally secured, about a horizontal axis, to the outer end of the second support leg. At least one brace is secured to the third and fourth support legs so as to extend therebetween.

The third and fourth support legs are selectively pivotally movable with respect to the first and second support legs between a first generally horizontally disposed paddle board loading position and a second generally vertically disposed paddle board storage position. An elongated flexible first rope, having first and second ends, has its first end operatively connected to the third and fourth support legs with the second end of the first rope configured to extend to the dock whereby a person on the dock may use the first rope to move the third and fourth support legs between the first and second positions.

When the third and fourth support legs are in their horizontally disposed first position, a paddle board may be placed thereon. The first rope is then utilized to pivotally move the third and fourth support legs and the paddle board thereon upwardly and inwardly so as to be positioned adjacent the lift frame. The lift handle may then be used to move the lift frame and the paddle board upwardly to a stowed position adjacent the boat dock at one side thereof.

It is therefore a principal object of the invention to provide an improved paddle board dock rack which is adapted to be secured to one side of a dock.

A further object of the invention is to provide an improved paddle board dock rack wherein the paddle board may be mounted thereon and be pivotally moved towards the frame of the rack and then be moved upwardly out of the water for storage beside the side of the dock.

A further object of the invention is to provide a paddle board dock rack of the type described including means for locking the lift frame of the invention with the paddle board thereon in an upper position out of the water.

A further object of the invention is to provide a paddle board dock rack which is easy and safe to use and does not require a person to enter the water to move a paddle board from a floating position to a storage position and vice versa.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
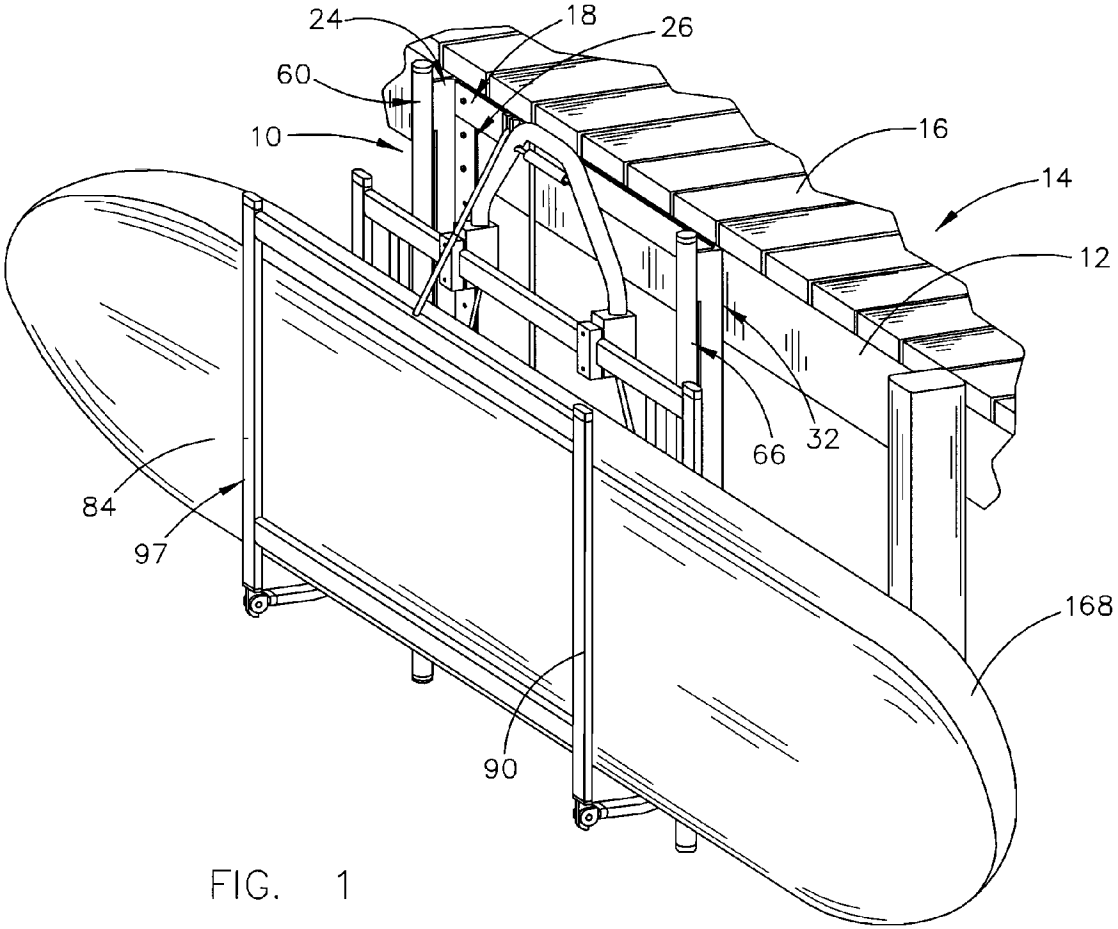
FIG. 1 is a perspective view of the paddle board dock rack of this invention secured to one side of a dock with a paddle board positioned thereon.
Figure 2:
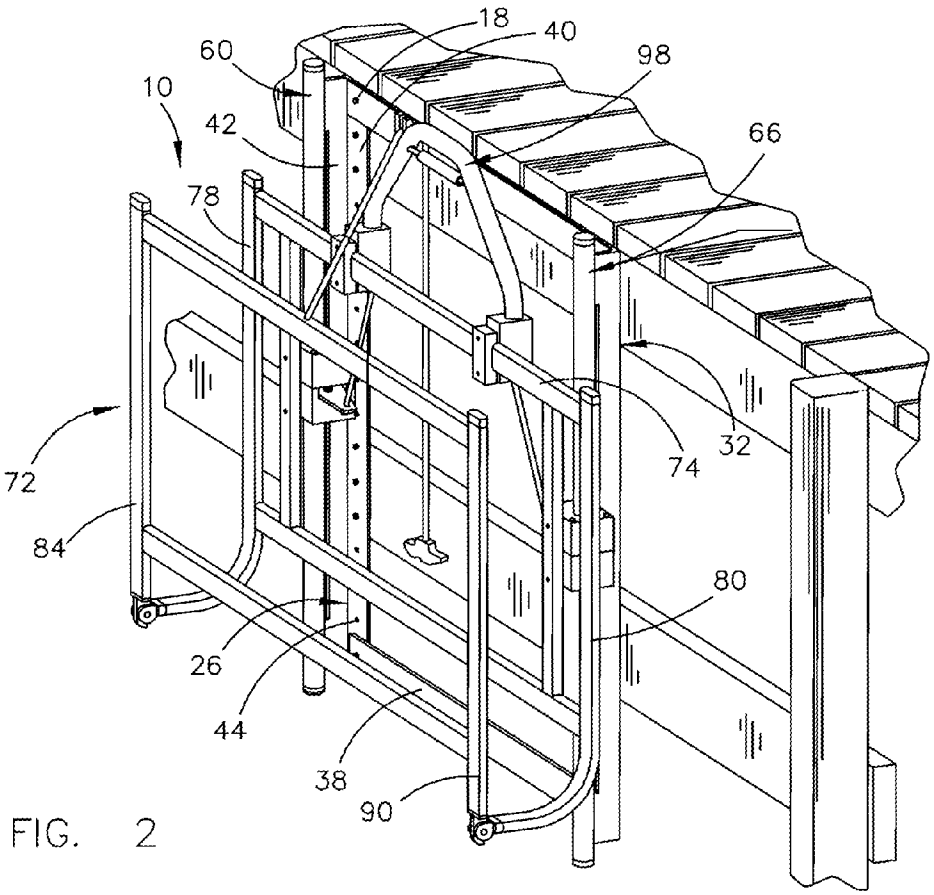
FIG. 2 is a perspective view of the paddle board dock rack of this invention secured to one side of a dock.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the paddle board dock rack of this invention which is designed to be secured to the side 12 of a conventional boat dock 14 having a platform or deck 16. Dock rack 10 includes a mounting frame 18 which is secured to side 12 of the dock 14 or to the end of the dock 14. Frame 18 includes a horizontally disposed upper frame member 20 having ends 22 and 24. A vertically disposed frame member 26, having an upper end 28 and a lower end 30, has its upper end 28 secured to end 22 of frame member 20 and extends downwardly therefrom. A vertically disposed frame member 32, having an upper end 34 and a lower end 36, has its upper end 34 secured to end 24 of frame member 20 and extending downwardly therefrom. Preferably, a horizontally disposed lower frame member 38 has its ends secured to the lower ends 30 and 36 of frame members 26 and 32 respectively and extends therebetween.

Frame member 26 has an angular cross-section and includes a base portion 40 and an angular portion 42 which extends transversely outwardly from the outer end of base portion 40. Base portion 40 has a plurality of vertically spaced-apart fastener opening 44 formed therein.

Frame member 32 has an angular cross-section and includes a base portion 46 and an angular portion 48 which extends transversely outwardly from the outer end of base portion 46. Base portion 46 has a plurality of vertically spaced-apart fastener openings 50 formed therein.

The upper outer end of angular portion 42 has a stand-off member 52 extending outwardly therefrom. The lower outer end of angular portion 42 has a stand-off member 54 extending outwardly therefrom. The upper outer end of angular portion 48 has a stand-off member 56 extending outwardly therefrom. The lower outer end of angular portion 48 has a stand-off member 58 extending outwardly therefrom.

The numeral 60 refers to an elongated and vertically disposed tube having an upper end 62 and a lower end 64. The tube 60 is welded or otherwise secured, at its upper end, to the outer end of stand-off member 52 and is welded or otherwise secured, at its lower end, to the outer end of stand-off member 54. The number 66 refers to an elongated and vertically disposed tube having an upper end 68 and a lower end 70. The tube 66 is welded or otherwise secured, at its upper end, to the outer end of stand-off member 56 and is welded or otherwise secured, at its lower end, to the outer end of stand-off member 58.

Base portions 40 and 46 of frame members 26 and 32 respectively are secured to the boat dock 14 by screws or bolts extending through the fastener openings 44 and 50 of base portions 40 and 46 and into the dock 14. The vertically spaced-apart fastener openings 44 and 50 enable the mounting frame 18 to be selectively vertically adjustably secured to the dock 14.

The numeral 72 refers to a lift frame which is vertically movably mounted on the tubes 60 and 66 as will now be described. Lift frame 72 includes a horizontally disposed upper frame member 74, a horizontally disposed lower frame member 76, a vertically disposed first side frame member 78 and a vertically disposed second side frame member 80. Lift frame 72 also includes a vertically disposed frame member 81 which is secured to frame members 74 and 76 so as to extend therebetween inwardly of frame member 78. Lift frame 72 further includes a vertically disposed frame member 82 which is secured to frame members 74 and 76 so as to extend therebetween inwardly of frame member 80.

Frame member 78 includes a curved support leg 83 which extends downwardly and outwardly from the lower end thereof. The outwardly extending portion of support leg 83 is telescopic so as to be length adjustable. An elongated support leg 84 has its inner end 86 pivotally secured, about a horizontal axis, to the outer end of the outwardly extending portion of support leg 83.

Frame member 80 includes a curved support leg 88 which extends downwardly and outwardly from the lower end thereof. The outwardly extending portion of support leg 88 is telescopic so as to be length adjustable. An elongated support leg 90, has its inner end 92 pivotally secured, about a horizontal axis, to the outer end of the outwardly extending portion of support leg 88. A brace 94 is secured to the outer ends of support legs 84 and 90 and extends therebetween. A brace 96 is secured to the support legs 84 and 90 at the inner ends thereof and extends therebetween. For ease of description, the numeral 97 will refer to the assembly which is comprised of support leg 84, support leg 90, brace 94 and brace 96.

The numeral 98 refers to a hollow handle including a grip portion 99 and legs 100 and 102 which are clamped onto frame member 74 by clamp assemblies 104 and 106 respectively. A bracket 108 is secured to leg 100 at the upper end and has a rope receiving slot 110 formed therein which extends downwardly thereinto from the upper end thereof. An elongated flexible rope or cable 112 has its lower end 114 secured to brace 94. The upper end of rope 112 has a T-shaped handle 116 secured thereto. Rope 112 has a knot 118 formed therein between the lower and upper ends thereof. Rope 112 is used to pivotally raise and lower assembly 97 as will be described in more detail hereinafter.

The numeral 120 refers to a slide block which is secured to frame member 81 as seen in the drawings for movement therewith. A slide block 120' is secured to frame member 82 as seen in the drawings for movement therewith. Inasmuch as slide block 120' is a mirror image of slide block 120, only slide block 120 will be described in detail with "'" indicating identical structure on slide block 120'.

Figure 11:
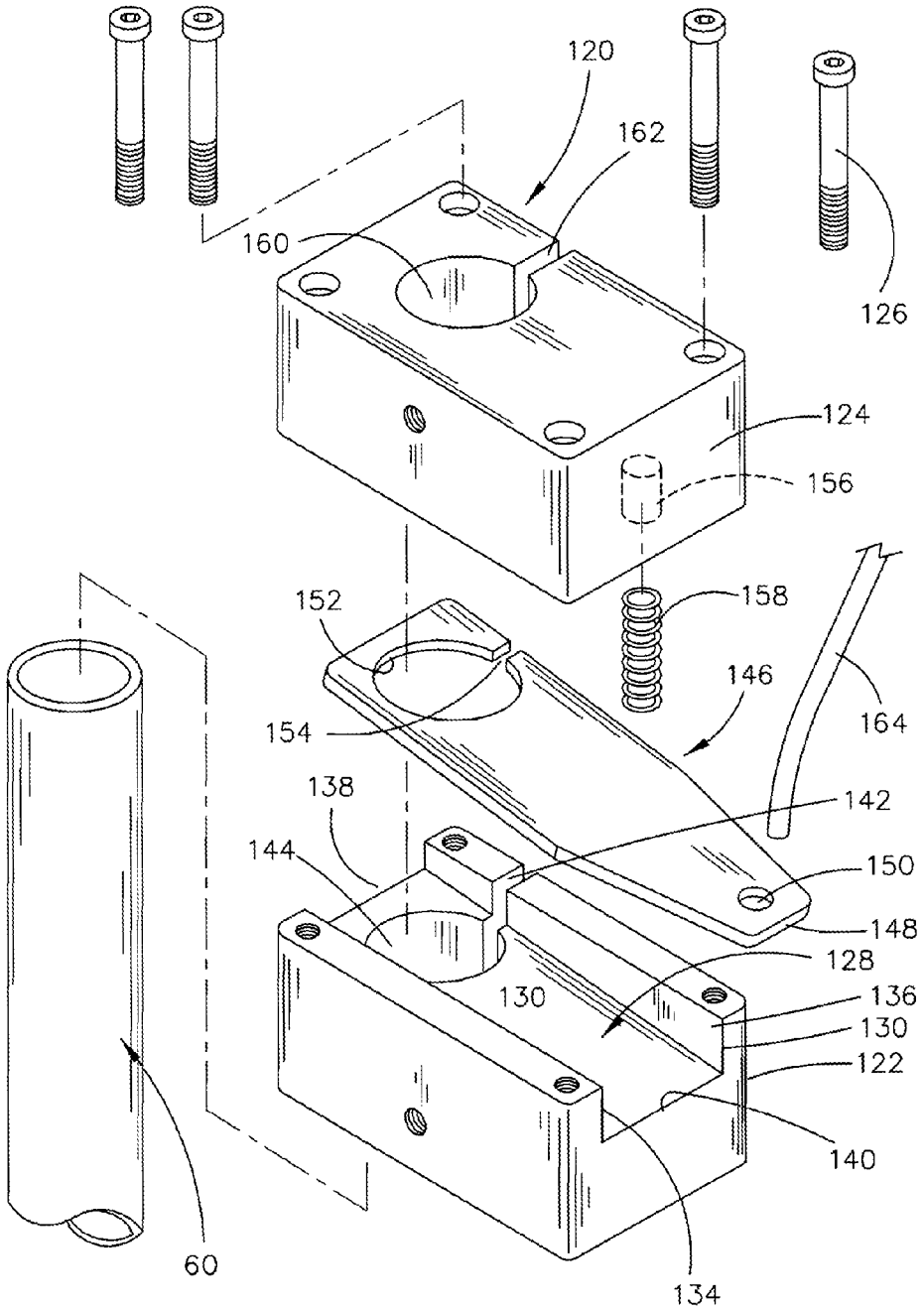
FIG. 11 is an exploded perspective view of one of the slide blocks of this invention.

Slide block 120 includes a lower block member 122 having an upper block member 124 secured thereto by screws or bolts 126. The upper side of lower block member 122 has an opening, notch or compartment 128 formed therein which is defined by an open inner end 130, an inclined lower wall 132, a vertically disposed side wall 134, a vertically disposed side wall 136, an open outer end 138 and an open inner end 140. Lower block member 122 has a vertically disposed slot 142 formed therein which movably receives the angular portion 42 of frame member 26. Lower block member 122 has a vertically disposed cylindrical opening 144 extending therethrough which movably receives the tube 60 therein. An elongated, flat locking tab 146 is positioned in the opening 128 as seen in the drawings so that the end 148 thereof is positioned outwardly of lower block member 122. Locking tab 146 has an opening 150 formed therein inwardly of end 148 thereof. Locking tab 146 has a cylindrical opening or bore 152 formed therein which movably receives the tube 60 therein. A slot 154 is formed in locking tab 146 as seen in FIG. 11.

The lower end of upper block member 124 is positioned upon the upper end of lower block member and has a cylindrical opening 156 extending upwardly thereinto which receives the upper end of a spring 158. Upper block member 124 also has a cylindrical opening or bore 160 formed therein which movably receives the tube 60 therein. A slot 162 is formed in upper block member as seen in FIG. 11.

Figure 12:
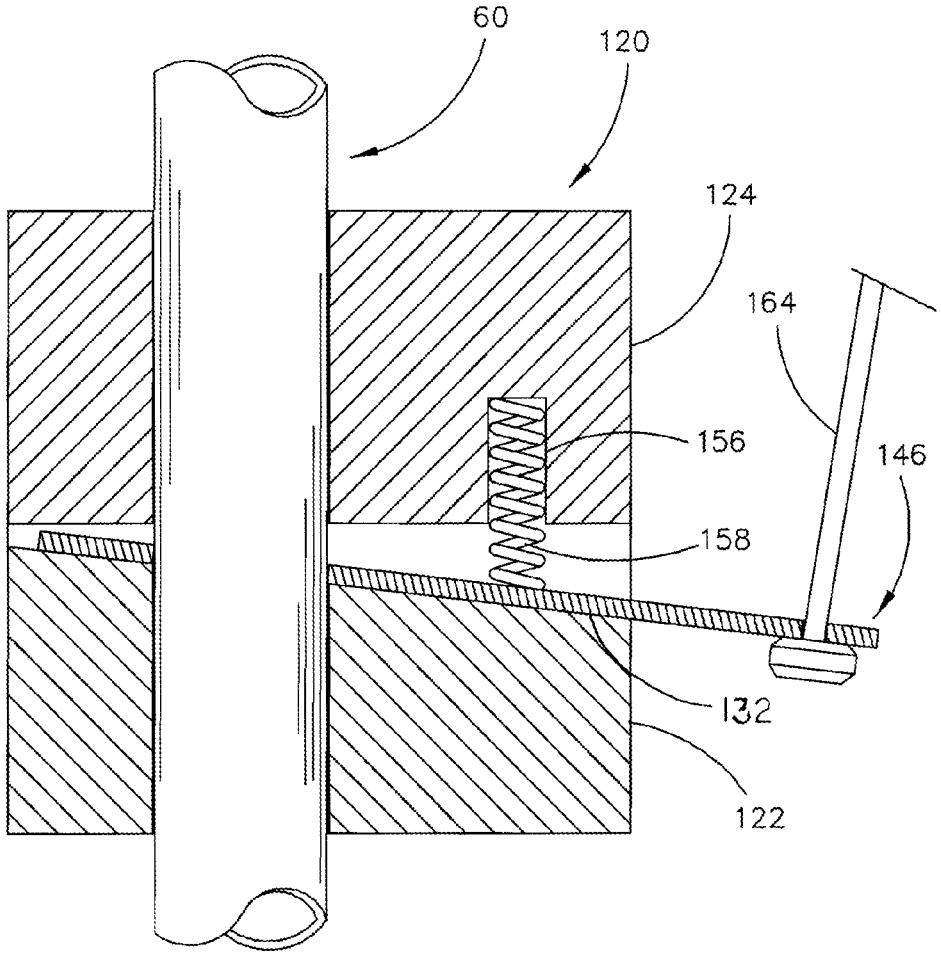
FIG. 12 is a sectional view of one of the slide blocks of this invention.
Figure 13:
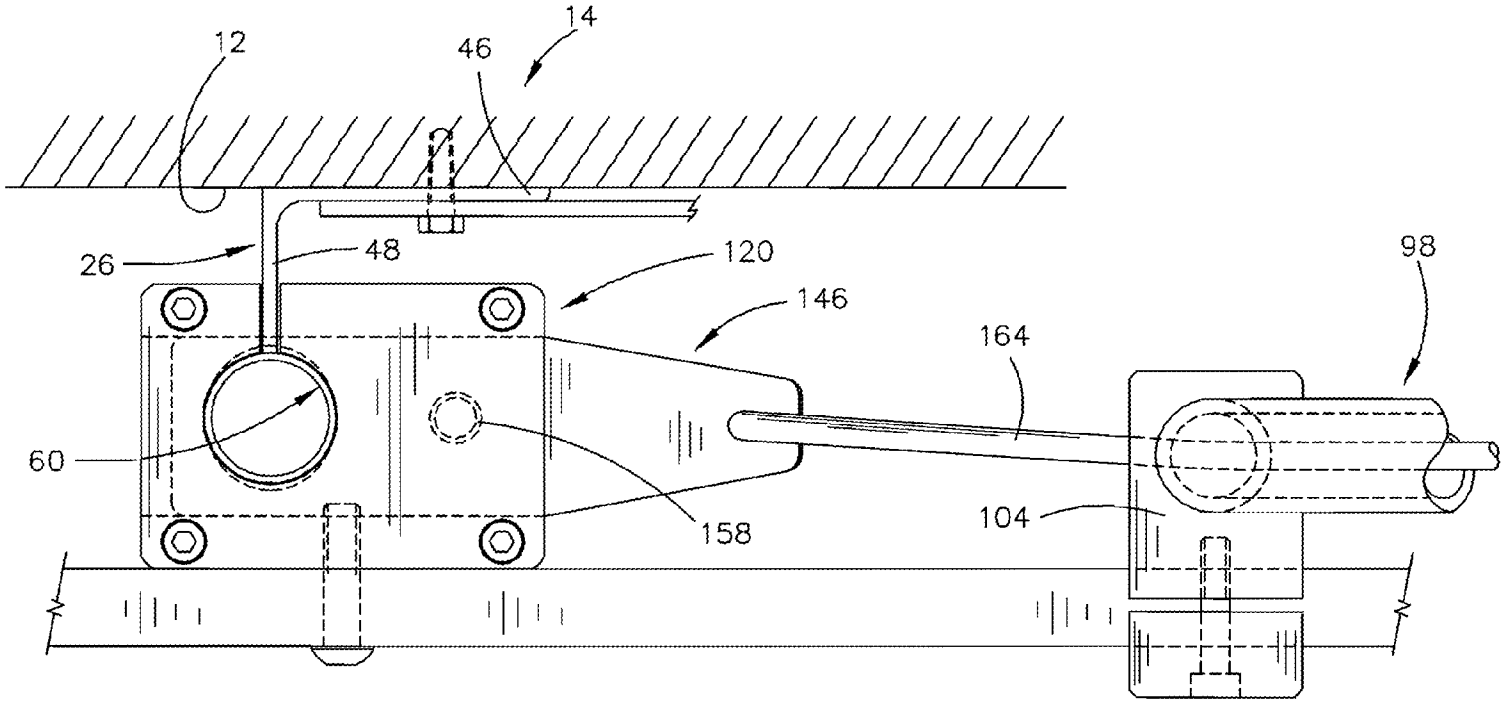
FIG. 13 is a partial view of the dock rack of this invention secured to the dock.

The compression spring 158 yieldably urges the locking tab 146 downwardly to its lower locking position as seen in FIG. 12. When the locking tab 146 is in its locked position, the central lower edge of opening 152 and the central upper edge of opening 152 bite into the exterior surface of tube 60 to lock the slide block 120 in position. When the locking tab 146 is pivotally moved upwardly from its locked position to its unlocked position, the slide block 120 may slidably move with respect to tube 60.

One end of a rope or cable 164 extends through opening 150 of locking tab 146 and is secured thereto by a knot or any other conventional means. Rope 164 extends upwardly and inwardly from locking tab 146 and extends inwardly into the interior of leg 100 of handle 98 by way of an opening formed in leg 100. Rope 164 extends upwardly through the interior of leg 100 and exits from leg 100 by way of an opening formed in leg 100 below grip portion 99 of handle 98. Rope 164 then extends through a tubular member 166, thence into leg 102 by way of an opening formed in leg 102. Rope 164 then extends downwardly through leg 102 and exits therefrom by way of an opening formed in leg 102. Rope 164 then extends downwardly for connection to locking tab 146' in slide block 120'.

Thus, the locking tabs 146 and 146' are normally in their locked positions due to the compression springs in slide blocks 120 and 120' which locks slide blocks 120 and 120' in position with respect to tubes 60 and 66 respectively. The locking tabs 146 and 146' may be moved to their unlocked positions by a person who grips the tubular member 166 and moves the tubular member 166 upwardly towards the grip portion 99 of handle 98. The upward movement of tubular member 166 causes the ends of rope 164 to pull the locking tabs 146 and 146' upwardly which moves the locking tabs 146 and 146' to their unlocked positions whereby slide blocks 120 and 120' may be moved with respect to tubes 60 and 66 respectively.

The method of using the paddle board dock rack 10 will now be described. Assuming that the dock rack is not being used, the lift frame 72 will usually be in its uppermost position with respect to the mounting frame 18. At that time, the slide blocks 120 and 120' will be in their locked positions with respect to tubes 60 and 66.

Figure 5A:
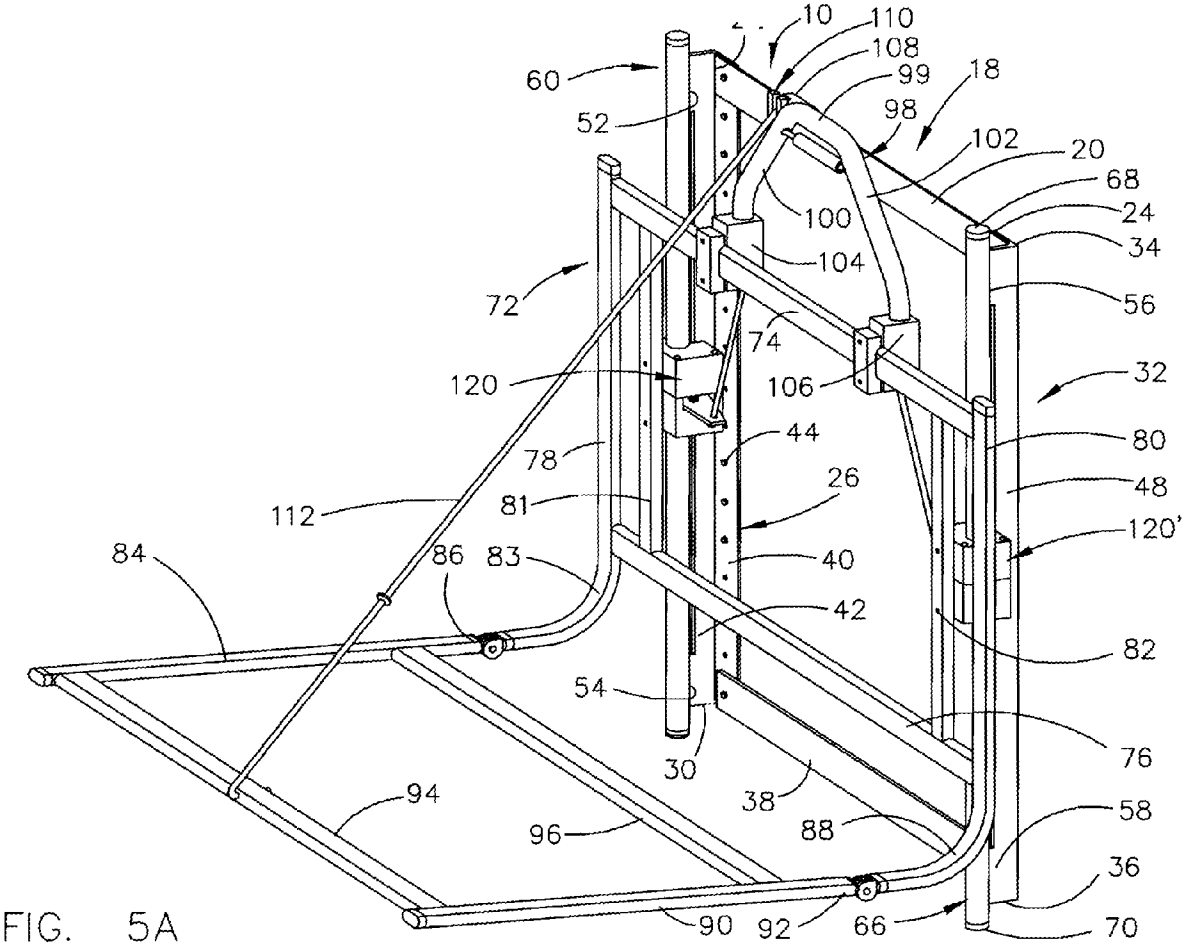
FIG. 5A is a perspective view similar to FIG. 4 except that the dock is not shown.
Figure 5B:
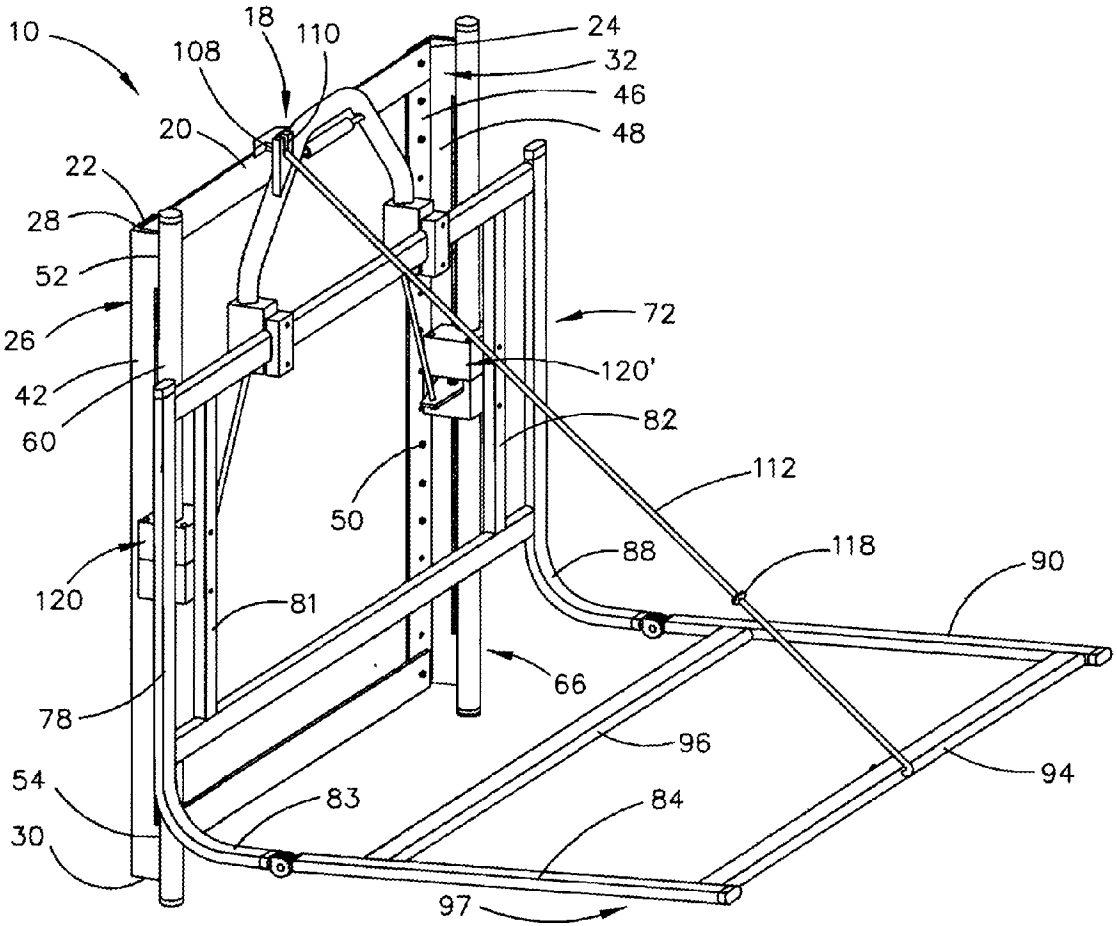
FIG. 5B is a perspective view similar to FIG. 5A as taken from another side of the dock rack.
Figure 6:
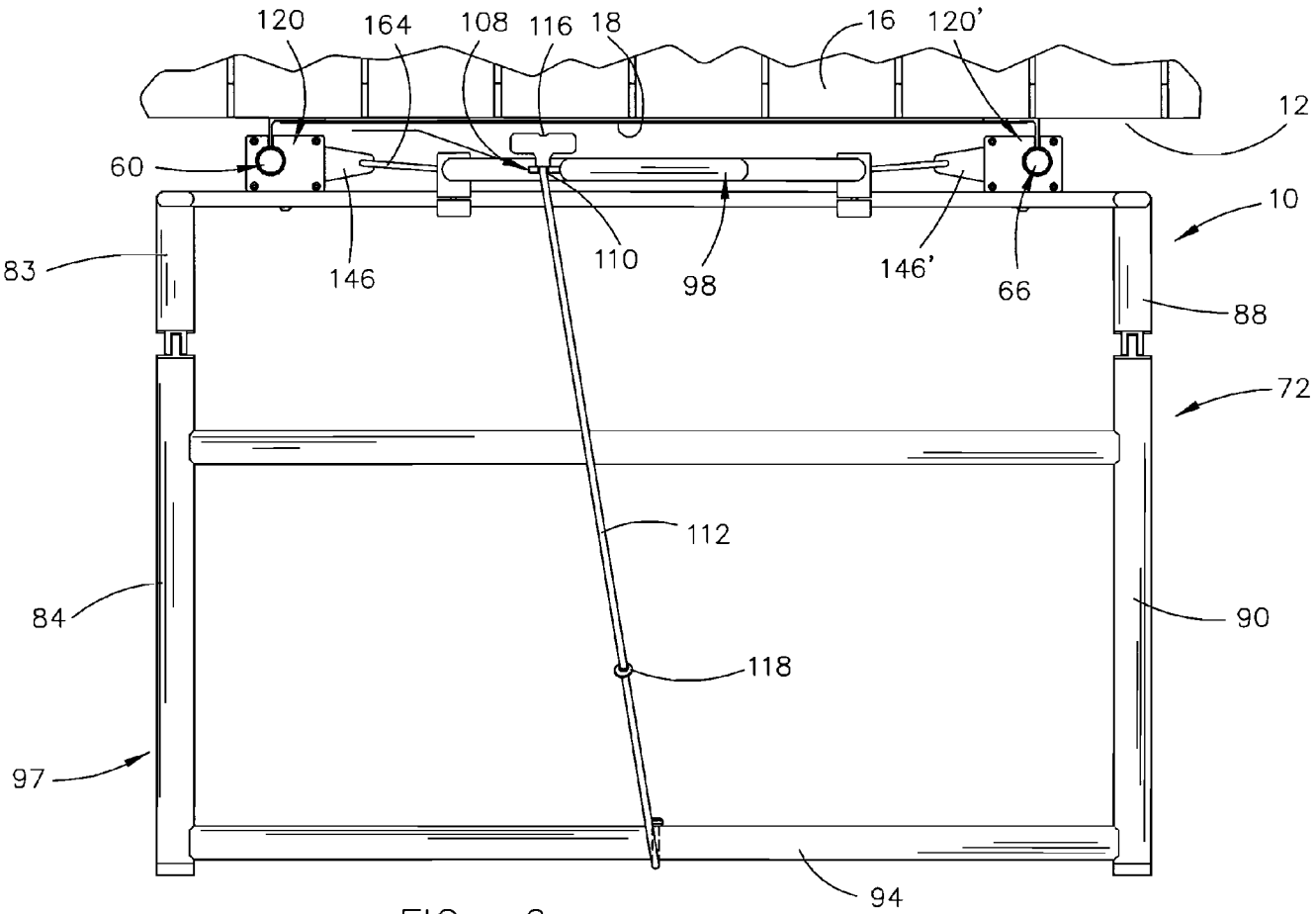
FIG. 6 is the top view of the dock rack of this invention secured to one side of a dock.
Figure 7:
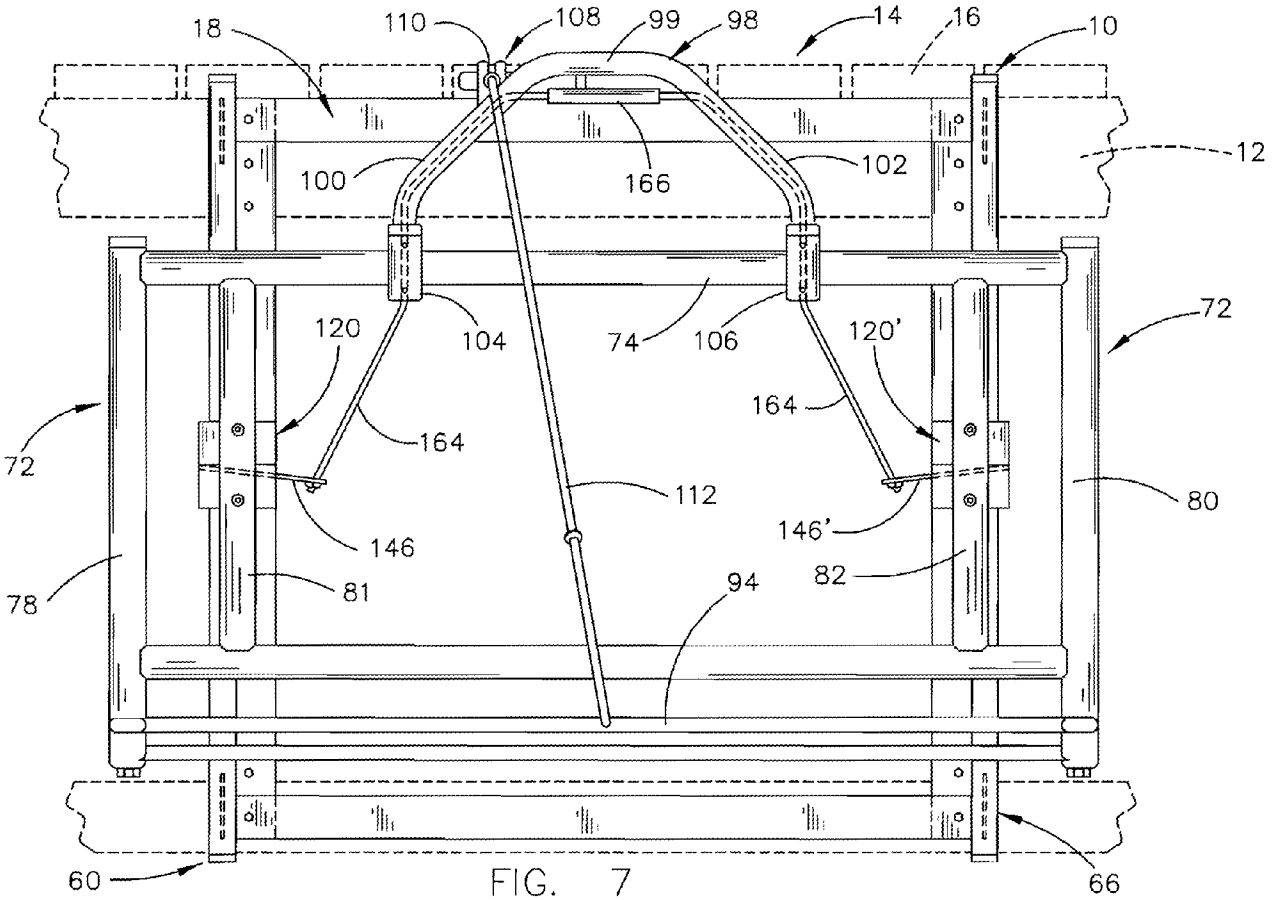
FIG. 7 is a front elevational view of the dock rack of this invention with the lift frame thereof being in a lower position and the support legs thereof being in a horizontally disposed position.
Figure 8:
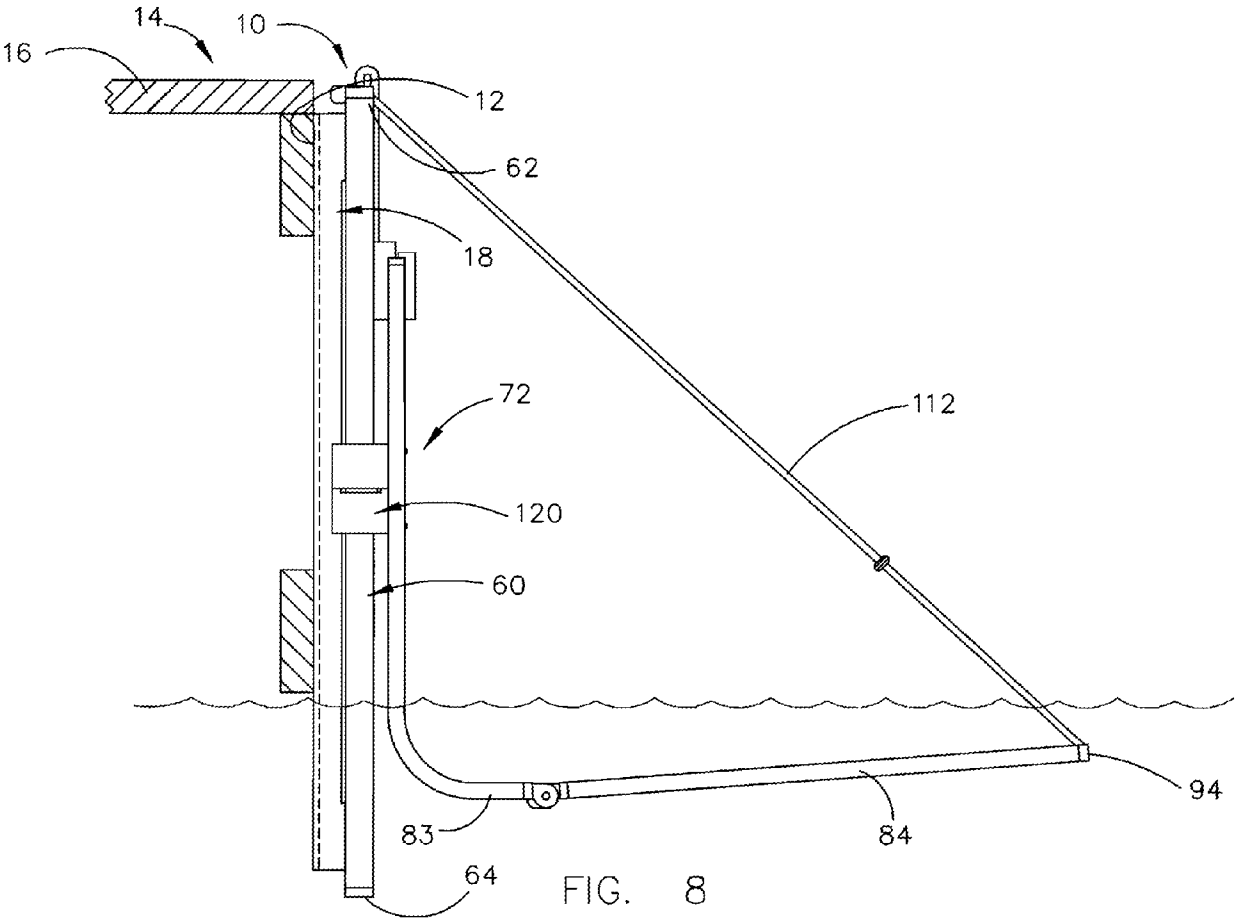
FIG. 8 is a partial side view illustrating the dock rack position of this invention with the support legs thereof in the horizontally disposed position.
Figure 9:
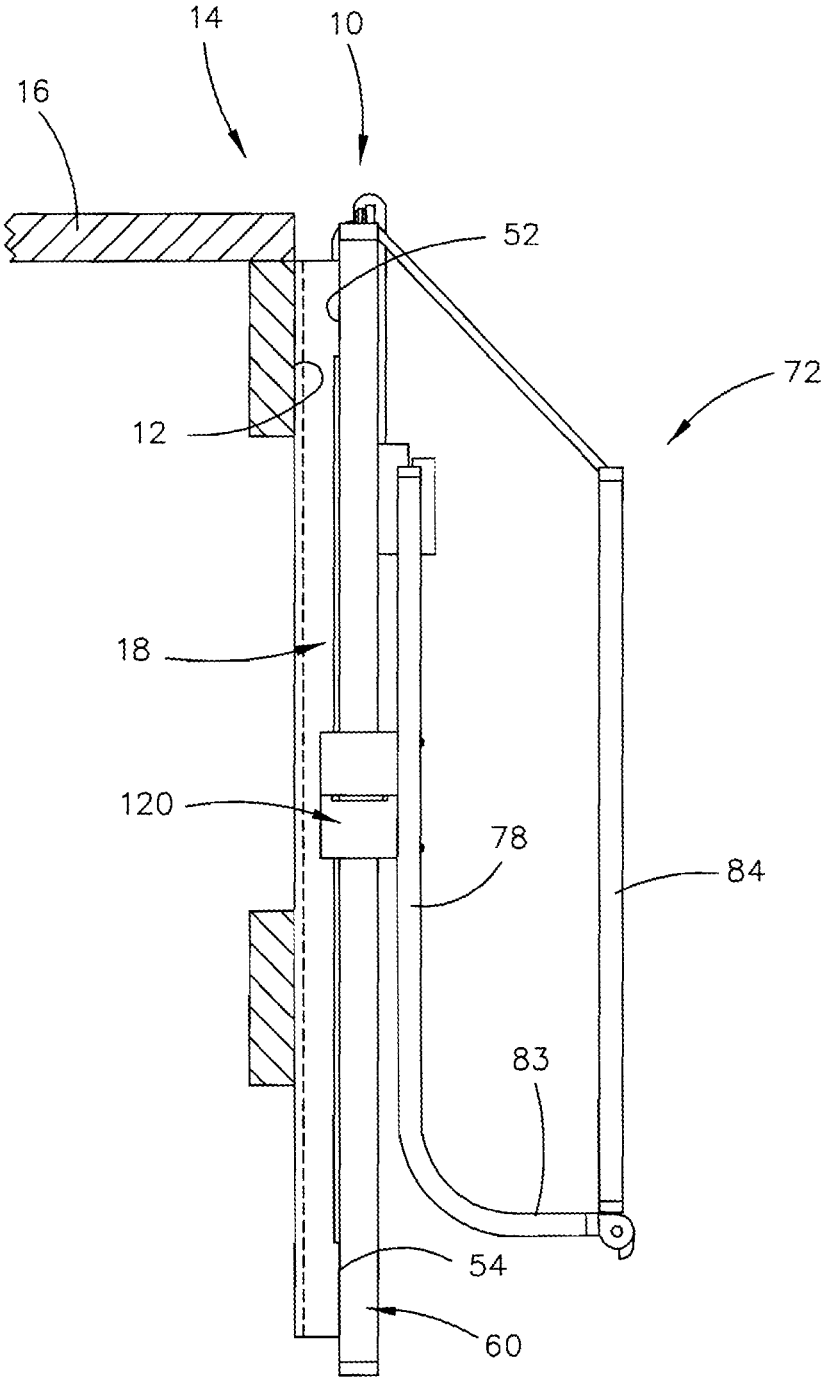
FIG. 9 is a side view of the dock rack of this invention with the support legs thereof in substantially vertically disposed position.
Figure 10:
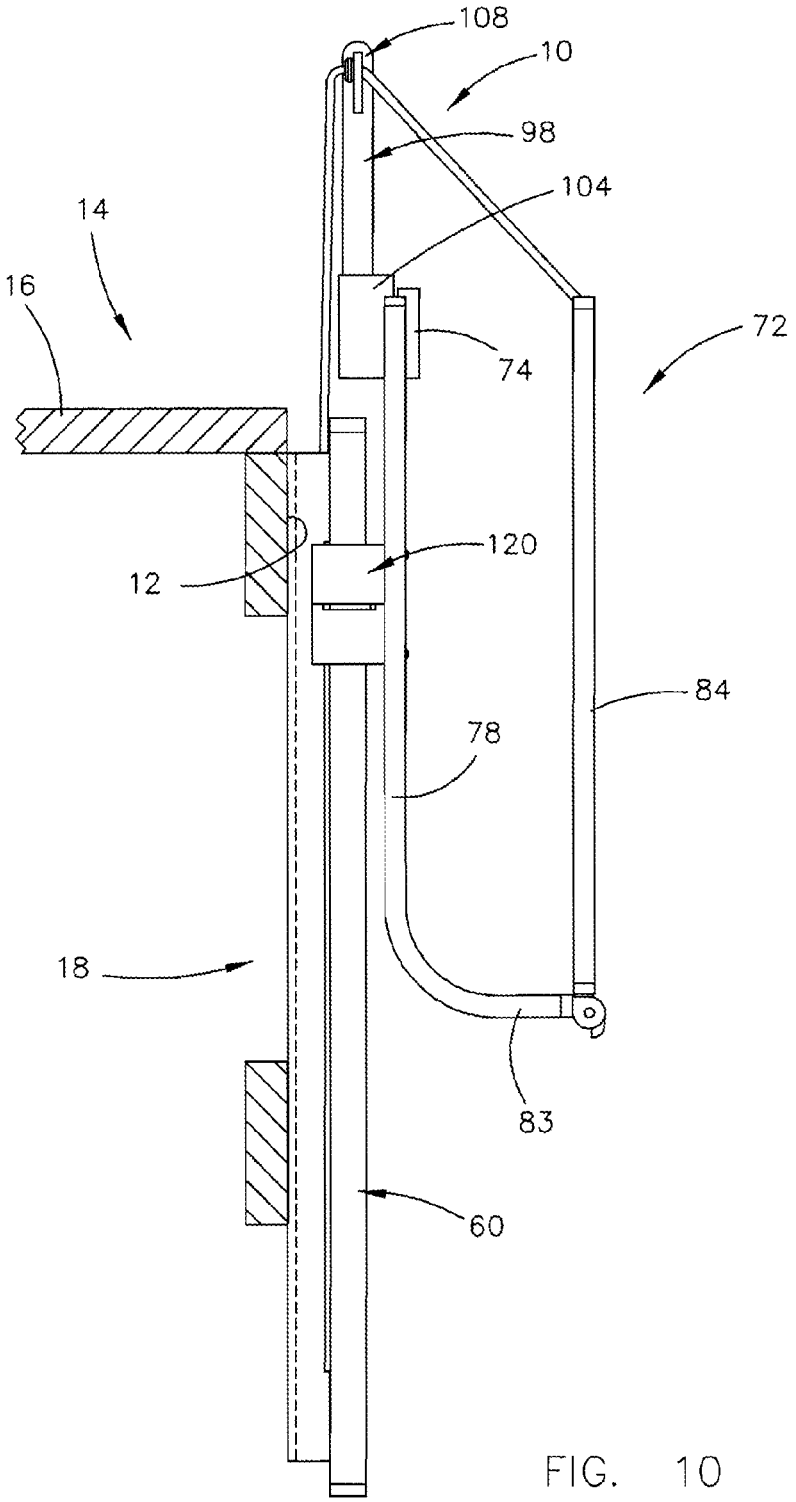
FIG. 10 is a partial sectional view illustrating the dock rack of this invention in its upper position and with the support legs thereof being in the vertically disposed position.

When it is desired to stow or rack a paddle board 168, the lift frame 72 will be lowered from the position of FIG. 10 to the position of FIG. 9. That position is possible by the person moving the locking tabs 146 and 146' in the slide blocks 120 and 120' to their unlocked position. When in the lowered position, the locking tabs 146 and 146' will then be moved to their locked positions. The assembly 97 will then be lowered to the position of FIGS. 5A and 8. At that time, the rope 112 will then be received in the slot 110 and the T-shaped handle 116 will maintain the lift assembly 97 in the position of FIG. 8.

Figure 3:
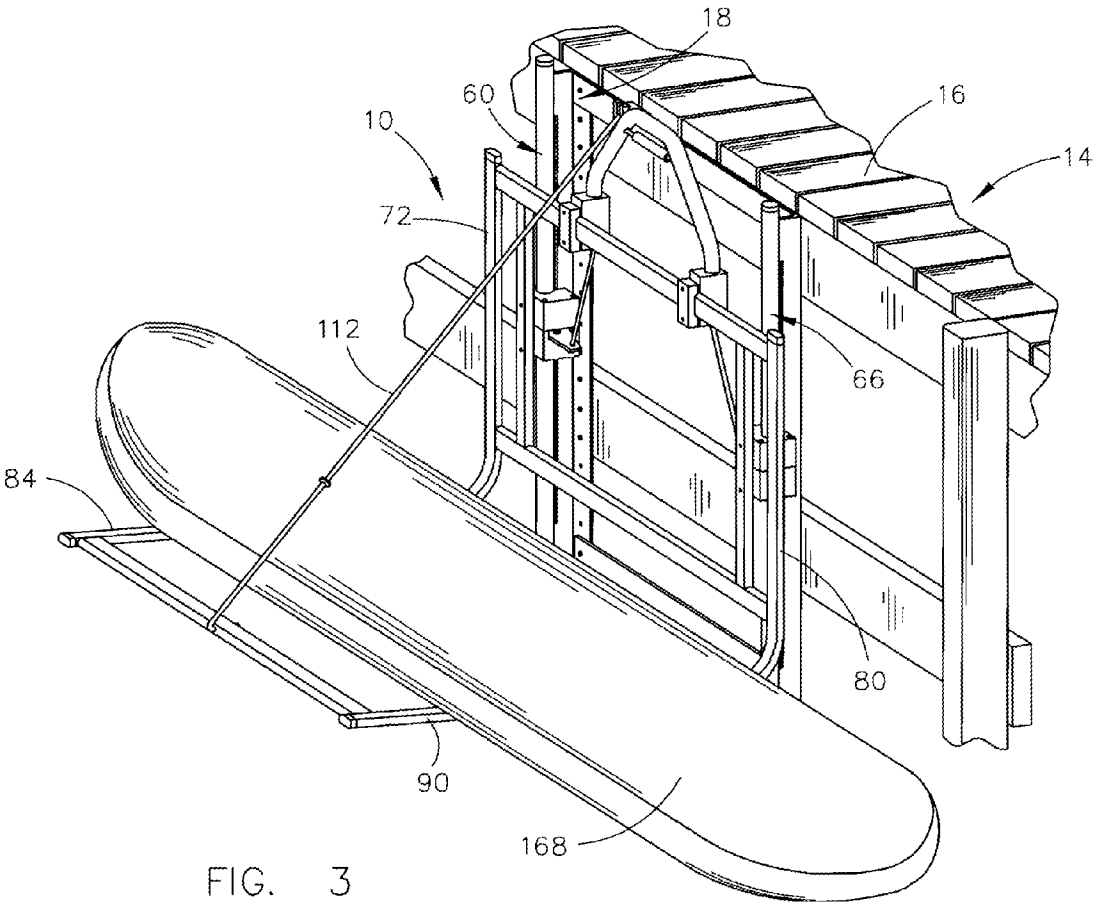
FIG. 3 is a perspective view which illustrates a paddle board being initially positioned on the dock rack of this invention.
Figure 4:
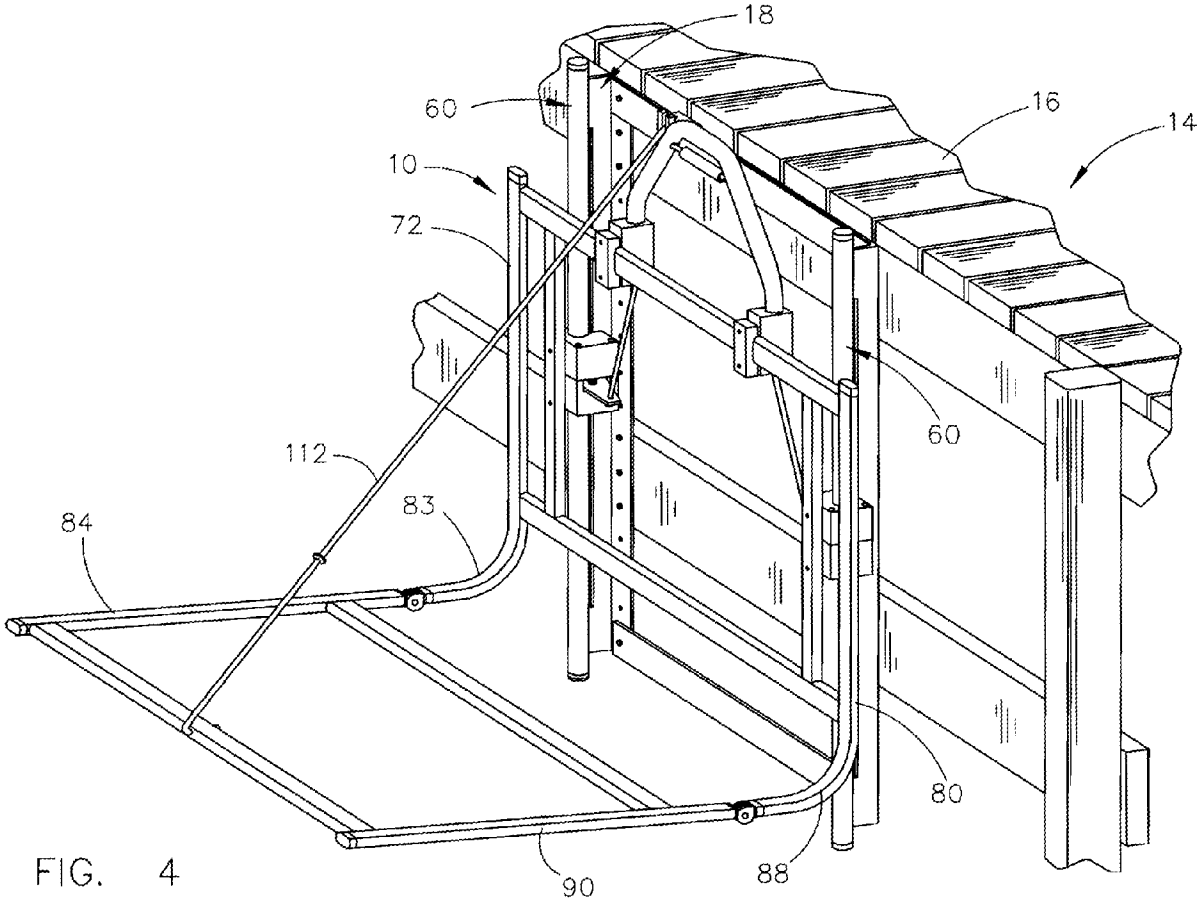
FIG. 4 is a view similar to FIG. 3 except that a paddle board is not positioned on the dock rack.

The paddle board 168 will then be floated onto the lift assembly 97. The rope 112 will then be pulled upwardly which causes the lift assembly 97 and the paddle board 168 to be moved from the position of FIG. 3 to the position of FIG. 1. At that time, the person will raise tubular member 166 to unlock slide blocks 120 and 120'. The lift handle 98 will then be raised to move the lift frame 72, the lift assembly 97, and the paddle board 168 to an upper position whereby the paddle board 168 is raised upwardly out of the water.

When it is desired to launch the paddle board 168, the lift frame 72 is lowered with respect to mounting frame 18 by unlocking slide blocks 120 and 120'. When the lift frame 72 is in its lower position, the rope 112 will be relaxed so that the lift assembly 97 and the paddle board can be lowered to the horizontally disposed position. The paddle board 168 may then be launched.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A paddle board dock rack for use with a dock extending outwardly into a body of water with the dock having sides and a deck, comprising:

a vertically disposed mounting frame configured to be secured to one side of the dock;

said mounting frame having an upper end, a lower end, a first side and a second side;

a first elongated vertically disposed support tube secured to said mounting frame at said first side thereof;

a second elongated and vertically disposed support tube secured to said mounting frame at said second side thereof;

a vertically disposed lift frame having an upper end, a lower end, a first side and a second side;

a first slide block secured to said lift frame at said first side thereof;

a second slide block secured to said lift frame at said second side;

said first and second slide blocks being selectively vertically slidably mounted on said first and second tubes respectively whereby said lift frame is selectively adjustably vertically movable between an upper position and a lower position with respect to said first and second tubes and said mounting frame;

a lift handle secured to said upper end of said lift frame which extends upwardly therefrom whereby a person on the dock may grasp the lift handle and move said lift frame between said upper and lower positions;

a first support leg, having inner and outer ends, extending outwardly from said lower end of said lift frame at said first side thereof;

a second support leg, having inner and outer ends, extending outwardly from said lower end of said lift frame at said second side thereof;

a third support leg having inner and outer ends;

said inner end of said third leg being selectively pivotally secured, about a horizontal axis, to said outer end of said first support leg;

a fourth support leg having inner and outer ends;

said inner end of said fourth support leg being selectively pivotally secured, about a horizontal axis, to said outer end of said second support leg;

said third and fourth support legs being selectively pivotally movable with respect to said first and second support legs between a first generally horizontally disposed paddle board loading position and a second generally vertically disposed paddle board storage position;

and an elongated flexible first rope, having first and second ends;

said first end of said first rope being operatively connected to said third and fourth support legs; and said second end of said first rope configured to extend to said upper end of said lift frame whereby a person on the dock may use said first rope to move said third and fourth support legs between said first and second positions.

2. The paddle board rack of claim 1 wherein each of said first and second slide blocks include a locking device which is normally in a locked position to lock said slide blocks to said support tubes and wherein said locking devices of said first and second slide blocks are configured to be selectively unlocked to enable said lift frame to be vertically moved on said support tubes.

3. The paddle board rack of claim 2 whereby the locking devices are configured to be remotely unlocked.

4. The paddle board rack of claim 2 whereby the locking devices are configured to be unlocked by way of a rope connected thereto.

5. The paddle board rack of claim 1 wherein each of said first and second support legs extend downwardly and thence outwardly from said lift frame.

6. The paddle board dock rack of claim 1 wherein said elongated flexible first rope is also configured to hold said third and fourth support legs in said paddle board loading position.

* * * * *